US007837269B2

(12) United States Patent
Bock

(10) Patent No.: US 7,837,269 B2
(45) Date of Patent: Nov. 23, 2010

(54) ARMREST, IN PARTICULAR FOR AN OFFICE CHAIR

(75) Inventor: Hermann Bock, Pyrbaum (DE)

(73) Assignee: BOCK1 GmbH & Co. KG, Postbauer-Heng (DE)

( * ) Notice: Subject to any disclaimer, the term of this patent is extended or adjusted under 35 U.S.C. 154(b) by 0 days.

(21) Appl. No.: 11/872,115

(22) Filed: Oct. 15, 2007

(65) Prior Publication Data

US 2008/0084103 A1 Apr. 10, 2008

(30) Foreign Application Priority Data

Apr. 13, 2005 (DE) ..... 10 2005 017 142

(51) Int. Cl.
*B60N 2/46* (2006.01)

(52) U.S. Cl. ..... 297/411.35; 297/411.36; 297/41.37; 297/411.38

(58) Field of Classification Search ..... 297/411.2, 297/411.36, 411.37, 411.38, 411.35
See application file for complete search history.

(56) References Cited

U.S. PATENT DOCUMENTS

| | | | | |
|---|---|---|---|---|
| 5,439,267 | A | 8/1995 | Peterson et al. | |
| 5,641,203 | A * | 6/1997 | Van De Riet et al. | 297/411.37 |
| 5,749,628 | A * | 5/1998 | Synder et al. | 297/411.36 |
| 6,017,091 | A * | 1/2000 | Cao | 297/411.37 |
| 6,076,891 | A * | 6/2000 | Bernhardt | 297/411.31 |
| 6,213,556 | B1 * | 4/2001 | Chen | 297/411.35 |
| 6,290,300 | B1 | 9/2001 | Sutton et al. | |
| 6,296,312 | B1 * | 10/2001 | Congleton et al. | 297/411.35 |
| 6,460,932 | B1 * | 10/2002 | Kopish et al. | 297/411.36 |
| 6,502,904 | B1 * | 1/2003 | Hansen | 297/411.35 |
| 6,663,182 | B1 * | 12/2003 | Dolci et al. | 297/411.35 |
| 6,948,775 | B2 * | 9/2005 | Tsai | 297/411.37 |
| 7,159,947 | B1 * | 1/2007 | Lee | 297/411.37 |
| 7,367,628 | B1 * | 5/2008 | Tsai | 297/411.35 |
| 2003/0178882 | A1 * | 9/2003 | Schmitz et al. | 297/411.36 |
| 2004/0066080 | A1 | 4/2004 | Maier et al. | |
| 2005/0189807 | A1 | 9/2005 | Norman et al. | |

FOREIGN PATENT DOCUMENTS

| | | | |
|---|---|---|---|
| DE | 10125996 | A1 | 11/2002 |
| DE | 202004004717 | U1 | 9/2004 |
| EP | 1424029 | A1 | 6/2004 |
| EP | 1568297 | A1 | 8/2005 |

* cited by examiner

*Primary Examiner*—Laurie K Cranmer
(74) *Attorney, Agent, or Firm*—Laurence A. Greenberg; Werner H. Stemer; Ralph E. Locher

(57) ABSTRACT

An armrest, in particular for an office chair, preferably has a height-adjustable armrest column and an arm support positioned on the armrest column. In order to improve the operation of an armrest of this type, it is recommended that a multi-function bearing head disposed on the armrest column be fitted, with a rotational, longitudinal and lateral adjustment mechanism for the arm support.

5 Claims, 7 Drawing Sheets

ARMREST, IN PARTICULAR FOR AN OFFICE CHAIR

CROSS-REFERENCE TO RELATED APPLICATIONS

This is a continuation, under 35 U.S.C. §120, of copending international application No. PCT/EP2006/003359, filed Apr. 12, 2006, which designated the United States; this application also claims the priority, under 35 U.S.C. §119, of German patent application DE 10 2005 017 142.7, filed Apr. 13, 2005; the prior applications are herewith incorporated by reference in their entirety

BACKGROUND OF THE INVENTION

1. Field of the Invention

The invention relates to an armrest, in particular for an office chair, preferably with a height-adjustable armrest column and an arm support positioned on the armrest column.

An armrest of this type is known from published, non-prosecuted German patent application DE 101 25 996 A1 submitted by the applicant. The armrest described therein can be adjusted with respect to its length and rotation. Particularly when a narrow basic armrest position is required, for example when the seat is wider than the inner dimensions of the arm supports, the limitations of the individual setting options for the armrests described therein become evident.

2. Brief Summary of the Invention

It is accordingly an object of the invention to provide an armrest, in particular for an office chair which overcomes the above-mentioned disadvantages of the prior art devices of this general type, which is particularly simple to construct.

With the foregoing and other objects in view there is provided, in accordance with the invention, an armrest. The armrest contains a height-adjustable armrest column, an arm support positioned on the armrest column, and a multi-function bearing head disposed on the armrest column and having adjustment mechanisms. The adjustment mechanisms include a rotational adjustment mechanism, a longitudinal adjustment mechanism and a lateral adjustment mechanism all for the arm support. The rotational adjustment mechanism enables the arm support to be rotated by 360 degrees.

According to this configuration, a multi-function bearing head is provided, which contains a mechanism for rotational, longitudinal and lateral adjustment.

In addition to the known rotational and longitudinal adjustment, a lateral adjustment of the armrest is also possible according to the invention.

Embodiments of the invention which have a simple construction, are easy to assemble, and yet guarantee reliable rotational, longitudinal and lateral adjustment.

The adjustment mechanisms are preferably catch-lock mechanisms, and are therefore particularly easy to operate and/or can be used without a release button. In other words, the position of the arm support can be altered without a release button having to be pressed. As a result, the armrest is particularly user-friendly.

The lateral adjustment mechanism in particular preferably contains a fixed location platform section acting in conjunction with a load bearing element which moves laterally in relation to the platform section. In a further embodiment of the invention, in order to realize the locking mechanism that can be activated without a release button, the platform section and the support element contain locking elements that act in conjunction with each other.

The multi-function bearing head is preferably structured in different function levels in such a way that in each case, a lower function level supports the overlying function levels. According to a particularly preferred embodiment of the invention, the support element for the lateral adjustment mechanism supports the entire longitudinal adjustment mechanism, while the rotational adjustment mechanism is in turn supported by the longitudinal adjustment mechanism, or is integrated into the latter.

In a further embodiment of the invention, the longitudinal adjustment mechanism contains a linear sliding guide. This is preferably configured in such a way that it contains a longitudinal guide frame in which a bearing block is inserted. This bearing block now preferably supports the rotational adjustment mechanism in turn, via which the arm support is connected to the multi-function bearing head.

If the rotational adjustment mechanism enables the arm support to be rotated by 360 degrees, a particularly flexible adjustment of the arm support is possible. This applies in particular when the arm support is asymmetrically formed in such a way that its longitudinal sides extend to different lengths. In connection with the lateral adjustment of the arm support, the option of a complete rotation of the arm support enables the inner dimension between the arm supports to be adjusted with a particularly large number of variations.

In a further embodiment of the invention, the arm support can be firmly latched into its standard position using a locking element. This is preferably achieved by only enabling the arm support to be turned after it has been unlocked by pressing a button. This ensures that the armrest always points towards the front in such a way that the user is provided with a comfortable support position.

Other features which are considered as characteristic for the invention are set forth in the appended claims.

Although the invention is illustrated and described herein as embodied in an armrest, in particular for an office chair, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1A:
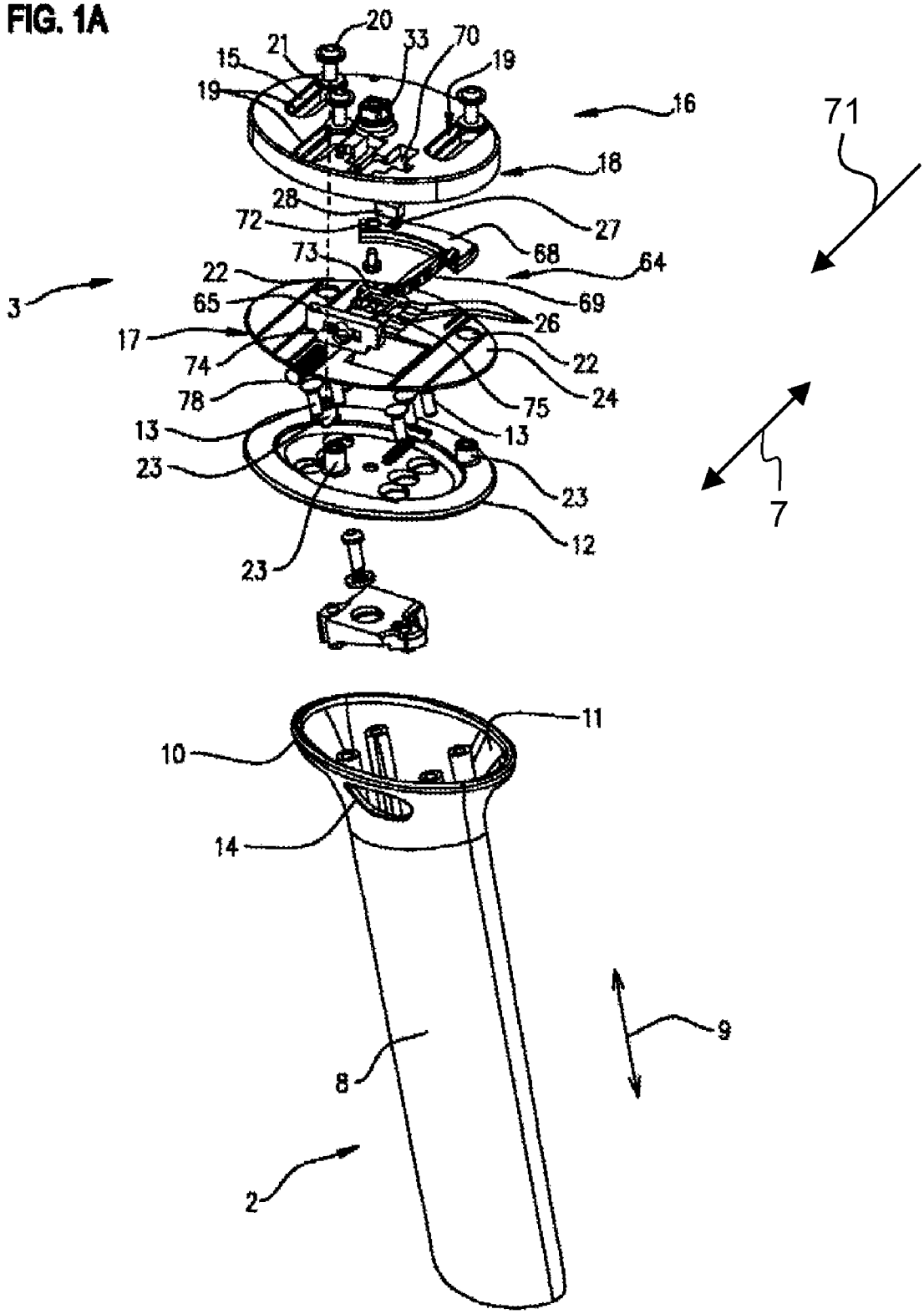
FIG. 1A is a diagrammatic, perspective exploded detailed view of an armrest support column from above according to the invention.
Figure 1B:
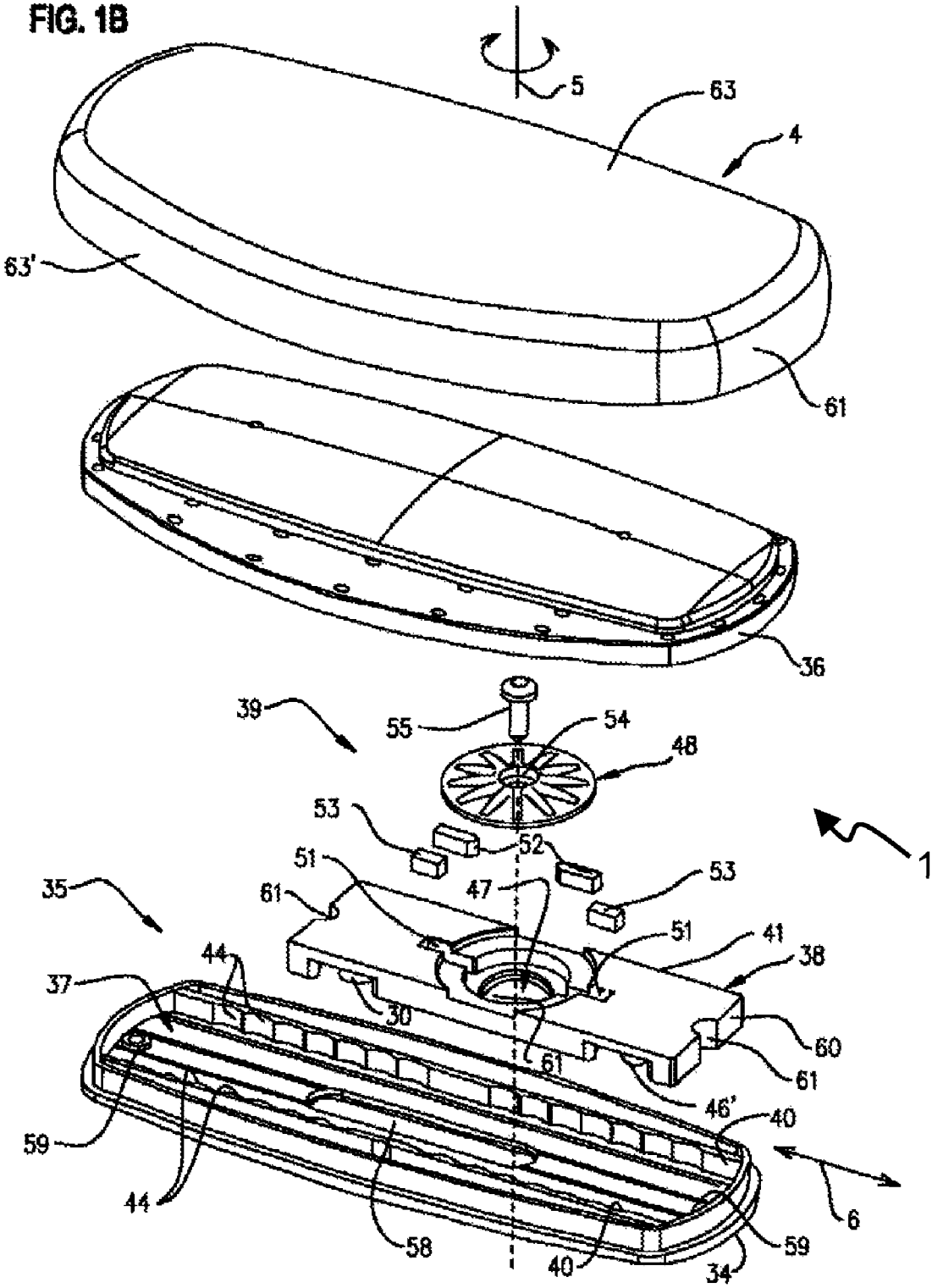
FIG. 1B is a diagrammatic, perspective exploded detailed view of an armrest.

Referring now to the figures of the drawing in detail and first, particularly, to FIGS. 1A and 1B thereof, there is shown an armrest 1 that contains a height-adjustable armrest column 2, in particular with a telescope-type structure, on an upper end of which a multi-function bearing head 3. This bears an arm support 4, which can be rotated around a vertical rotational axis 5, and which is retained on the bearing head 3 in such a way that it can be moved in both a longitudinal direction 6 and the a lateral direction 7.

A vertical side bar of the armrest column 2 takes the form of a guide holder, onto which an outer sleeve 8 of the armrest column 2 is guided in a vertical direction 9 in such a way that it can be moved. The guide holder contains a non-illustrated height-adjustable arresting device. A non-illustrated horizontal side bar formed on the armrest column 2 is used to affix the armrest 1 onto the base of an office chair or similar.

On an upper end of the armrest column 2, the outer sleeve 8 is extended outwards opposite the actual column section, thus forming a base 10 for the multi-function bearing head 3. The base 10 is open at the top, an opening 11 being closed by a lid-type base plate 12 of the multi-function bearing head 3. The base plate 12, which is made of a synthetic material, is screwed to the armrest column 2 using a number of attachment screws 13.

In order to adjust the height of the armrest 1, an operating lever is provided, the operating end of which (not shown) extends over an opening 14 which is open towards the outer side of the base 10. A possible configuration of the height adjustment mechanism is contained in published, non-prosecuted German patent application DE 101 25 996 A1 which is hereby incorporated by reference herein. However, in principle, other techniques can also be used to adjust the height.

A lateral adjustment mechanism 16 is disposed on the base plate 12, which is formed primarily of a platform section in the form of a locking plate 17 and a support element 18 which is attached to the plate 17 in such a way that it moves in a transverse direction 7. The support element 18 contains three guide channels 19 which are arranged at a distance from each other, offset in a triangular form, and which run in the transverse direction 7. Each of the guide channels 19 is assigned a bolt-type attachment element 20. Here, each attachment element 20 is fitted with a ring-shaped sliding element 21, and is inserted in the guide channel 19 in such a way that it affixes the locking plate 17 on the base plate 12 of the multi-function bearing head 3, while at the same time enabling the lateral adjustment of the support element 18. In the final mounting position, the sliding elements 21 lie on the collar of the attachment element 20 and rest on guide grooves 15 which run around the inner sides of the guide channels 19. The attachment elements 20 lead through the guide channels 19 and the corresponding retainer bore holes 22 in the locking plate 17 and act in conjunction with the screw threads that are fitted into three support elements 23, which extend upwards in a dome shape out of the base plate 12 to the support piece of the locking plate 17.

In an upper side 24 of the locking plate 17 which faces the load bearing element 18, a number of locking stages 26 have been created, which are disposed one after the other in a depression 25 in the lateral direction 7. A roll-shaped catch locking element 27 is fitted between the locking plate 17 and the load bearing element 18, which is impacted by a spring element in the form of an elastomer block 28, and which acts in conjunction with the locking stages 26. Here, the elastomer block 28 lies in a corresponding retainer 29 on the underside 31 of the load bearing element 18. In other words, the catch locking element 27 is moved from one locking stage 26 to the next by a lateral adjustment of the load bearing element 18, without activating a release button or similar, against the resistance of the elastomer block 28 and while being deformed by the block. Here, the locking stages 26 are preferably fitted with identical interim gradient surfaces on both sides, so that both the forward and backward movement can be achieved using the same amount of force.

The locking plate 17 is preferably made of a synthetic material, the locking stages 26 being formed during the manufacturing process as an integral part of the locking plate 17.

The load bearing element 18, which is preferably made of aluminum, contains on its upper side 32 an attachment dome 33 with an internal screw thread. This is used to attach a rotational and longitudinal adjustment mechanism on the lateral adjustment mechanism 16 in a manner to be explained below.

A longitudinal guide frame 34 for a longitudinal adjustment mechanism 35 is disposed directly on the load bearing element 18, and simultaneously serves as the support for a base element 36 of the arm support 4. In a guide channel 37, which primarily runs over the entire length of the longitudinal guide frame 34, a bearing block 38 for a rotational adjustment mechanism 39 is inserted. Here, the bearing block 38 is guided longitudinally by guide flanks 40 which run in the longitudinal direction 6 on both sides of the longitudinal guide frame 34 and the corresponding counterpart guide flanks 41 on the bearing block 38.

To provide compensation-for-play in the lateral direction 7, two pairs of spring elements, which are made of an elastic material such as rubber, are fitted to the underside 42 of the bearing block 38. One of the spring element pairs 30, 30', is shown as an example. The individual spring elements, which contain a spherical profile when not mounted, lie under tension in oval receptacles 43 on the bearing block 38. Here, they lie with their outer jacket surfaces on locking depressions 44, which are arranged in the guide flanks 40 of the longitudinal guide frame 34, and which primarily extend over the entire length of the guide channel 37. When mounted, the long semiaxes of the receptacles 43 are larger, and the short semiaxes of the receptacles 43 are smaller than the outer diameter of the spring elements. Here, the distance between the locking depressions 44 has been selected in such a way that all four spring elements always lie in the locking depressions 44.

The spring elements take the form of a short piece of pipe and contain identical inner diameters. The two spring elements 30, 30' of a spring element pair are placed with their openings onto retaining cylinders 46, 46' with spherical profiles. Here, each single spring element 30 of a spring element pair is allocated one retaining cylinder 46 with a profile which corresponds to the inner diameter of the spring element, while the other spring element 30' of the spring element pair is allocated one retaining cylinder 46' with a significantly smaller profile. As a result, when the bearing block 38 is moved in the longitudinal direction 6, the spring element 30' allocated to the retaining cylinder 46' with the smaller diameter is deformed, while the corresponding second spring element 30 remains almost undeformed. Here, in the sliding direction 6, the retaining cylinders 46, 46' with different diameters alternate with each other. This guarantees that the spring elements 30, 30' lie on the guide flanks 40, thus providing compensation-for-play at all times. In addition, the roll-shaped spring elements 30, 30', act in conjunction with the locking depressions 44 to form a release button-free, locking adjustment mechanism, with which both the forward and backward movements of the bearing block require the same amount of force due to the uniform configuration of the locking depressions 44.

The bearing block 38 contains in its center a primarily spherical retainer recess 47, in which a locking mechanism lies for the rotational adjustment mechanism 39. A spherical locking disc 48 is provided for this purpose, which is fitted on its underside 49 with radially arranged locking stages 50, and which lies at least partially in the retainer recess 47 of the bearing block 38. In order to create the rotational lock, the retainer recess 47 contains two depressions 51, which are opposite each other, and which run in the longitudinal direction of the bearing block and in the center of the bearing block 38, and which serve to retain the locking elements in the form of sliding blocks 52. These are impacted by the spring elements in the form of elastomer blocks 53, which can be inserted while mounding into the depressions 51 which are open at the top behind each of the sliding blocks 52.

The locking disc 48 contains a central bore hole 54 which takes a generally quadratic form on the underside 49 of the locking disc 48 in order to act in conjunction with the attachment dome 33 of the load bearing element 18. For this purpose, the attachment dome 33 contains a generally quadratic profile in its upper section that is configured to be inserted into the bore hole 54. The bore hole 54 serves to retain a holding screw 55, which is used to affix the locking disc 48, the bearing block 38 and the longitudinal guide frame 34 to the attachment dome 33 of the load bearing element 18. For this purpose, the retainer recess 47 of the bearing block 38 contains a central, spherical opening 56. In the same way, a corresponding guide channel 58 for adjustment in the longitudinal direction 6 is fitted in the end plate 57 of the longitudinal adjustment mechanism 35 which connects the guide flanks 40 of the longitudinal guide frame 34, and which retains the attachment dome 33.

The base element 36 of the arm support 4 is connected with the longitudinal guide frame 34 of the longitudinal adjustment mechanism 35 via screw connections 59. In order to be able to move the bearing block 38 in the longitudinal guide frame 34 as far as possible in the longitudinal direction 6, recesses 61 for the screw connections 59 are fitted on the lateral sides 60 of the bearing block 38.

The arm support cushion 61 is attached to the base element 36 via a snap or lock connection 62.

In order to move the arm support longitudinally and/or laterally on the multi-function bearing head 3, only the arm support 4 needs to be held and moved accordingly. Since no release buttons are provided for the longitudinal and lateral adjustment, this operation can be achieved with the minimum of effort.

Since the arm support 4 is asymmetrically formed in such a way, that the longitudinal sides 63, 63' extend out differently in the lateral direction 7, a particularly variable inner dimension between the arm supports 4 can be created by rotating the arm support 4 by 180°.

The multi-function bearing head 3 according to the invention can be used with any armrest 1, in particular with those armrests for which the height can be adjusted in the armrest column 2. Naturally, however, the multi-function bearing head 3 can also be used for armrests that have no height adjustment.

Figure 2A:
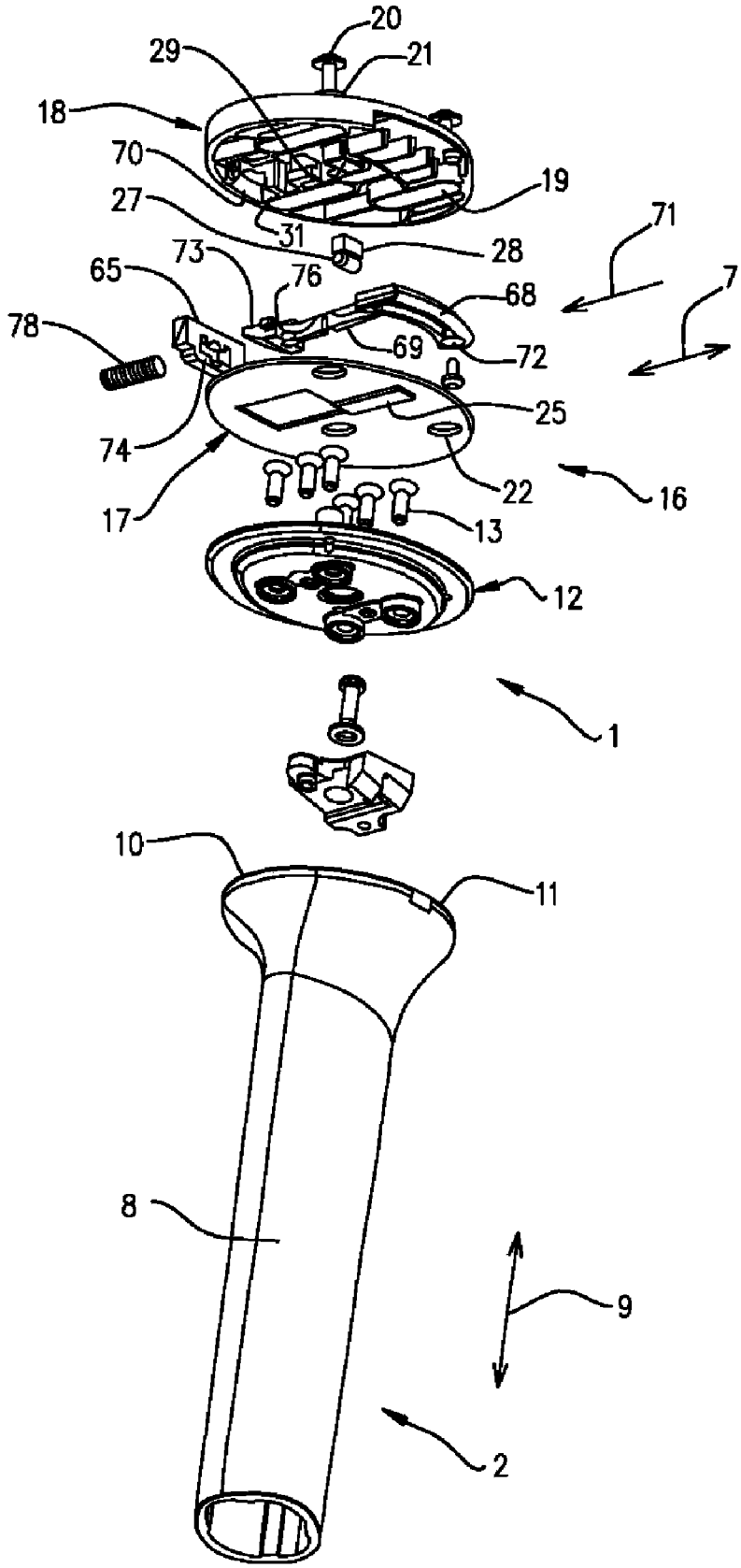
FIG. 2A is a diagrammatic, perspective exploded detailed view of the armrest support column from below.
Figure 2B:
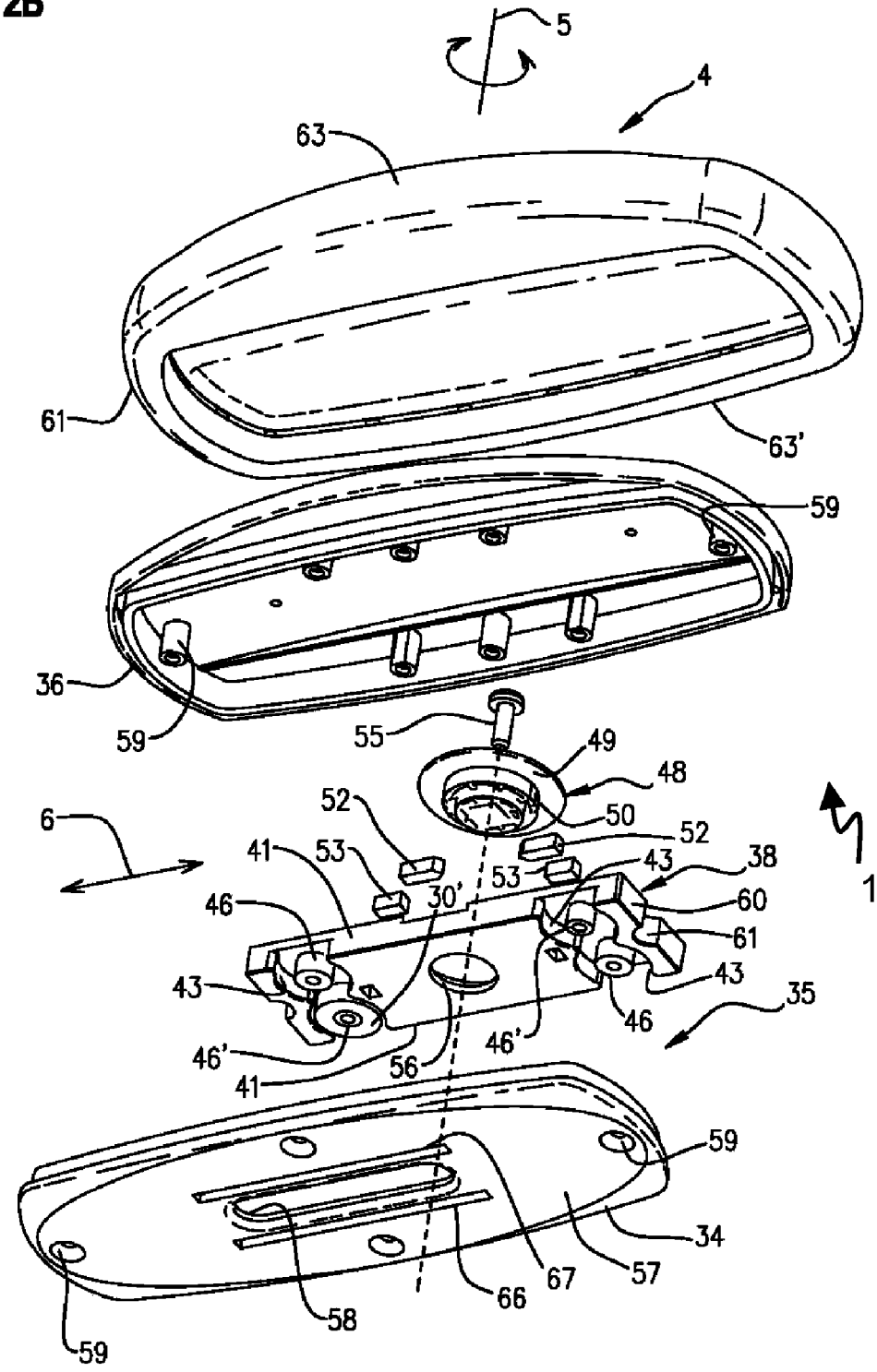
FIG. 2B is a diagrammatic, perspective exploded detailed view of the armrest.
Figure 3:
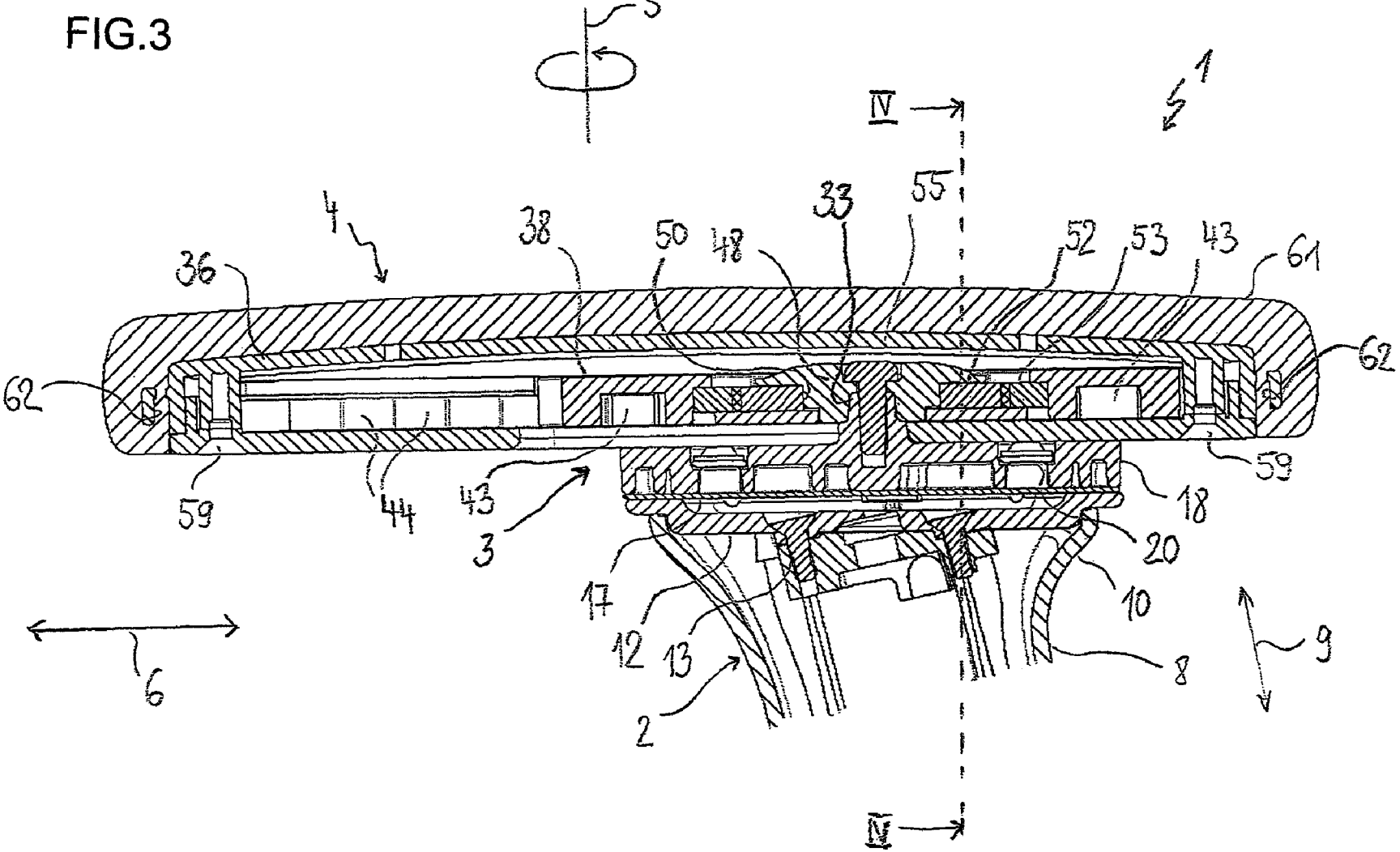
FIG. 3 is a diagrammatic, longitudinal sectional view of the armrest.
Figure 5:
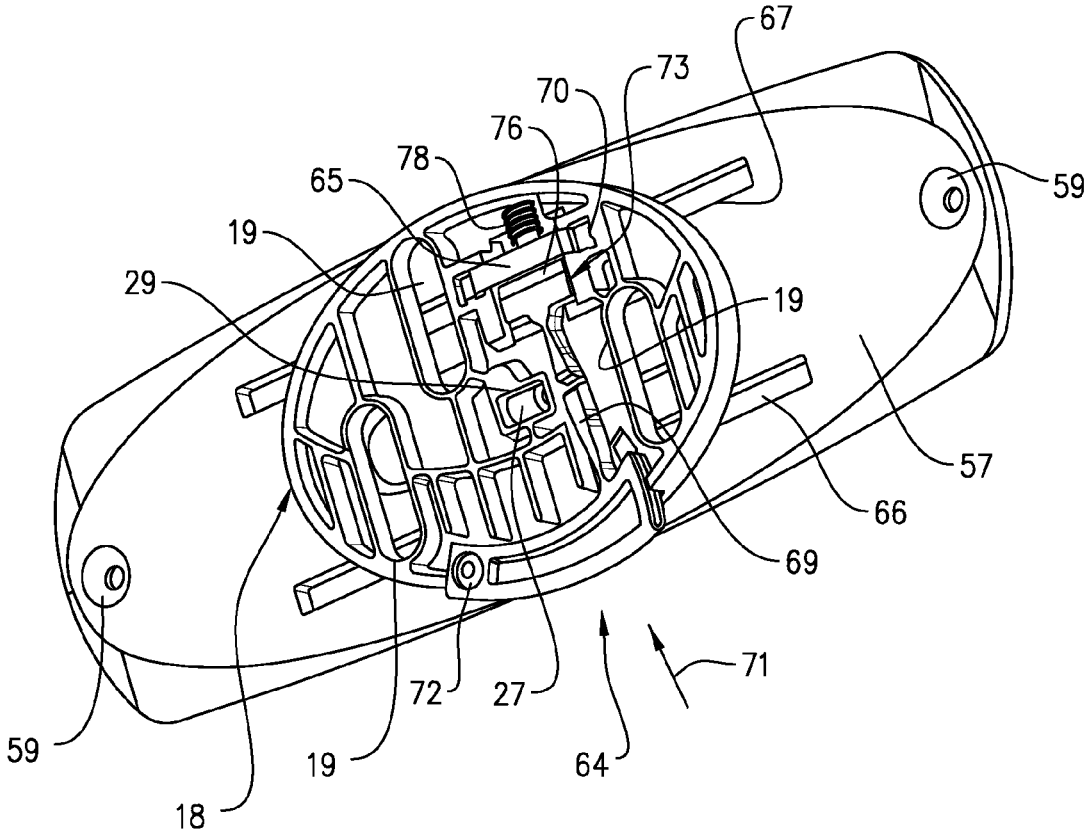
FIG. 5 is a perspective view of the underside of a longitudinal guide frame with a load bearing element.

In addition, the armrest 4 has a locking mechanism in its standard position. For this purpose, a button 64 and a locking tappet 65 are fitted between the load bearing element 18 and the locking plate 17, see FIGS. 1A and 2A, and FIG. 5. A locking tappet 65 extends through a penetration opening 70 through the load bearing element 18, and when locked, reaches into one of locking recesses 66 or 67 on an end plate 57. In its standard positions, which are defined by the position of the locking recesses 66, 67, approximately parallel to the guide channel 58, the arm supports 4 are arranged approximately vertically to the back rest of the office chair (not shown). Due to the arrangement of the locking recesses 66, 67 in the end plate 57, the standard position can naturally also be set so that the arm supports 4 stand slightly at an angle to each other, for example, in such a way that they correspond to the position of the lower arms of a user working at a computer keyboard.

Figure 4:
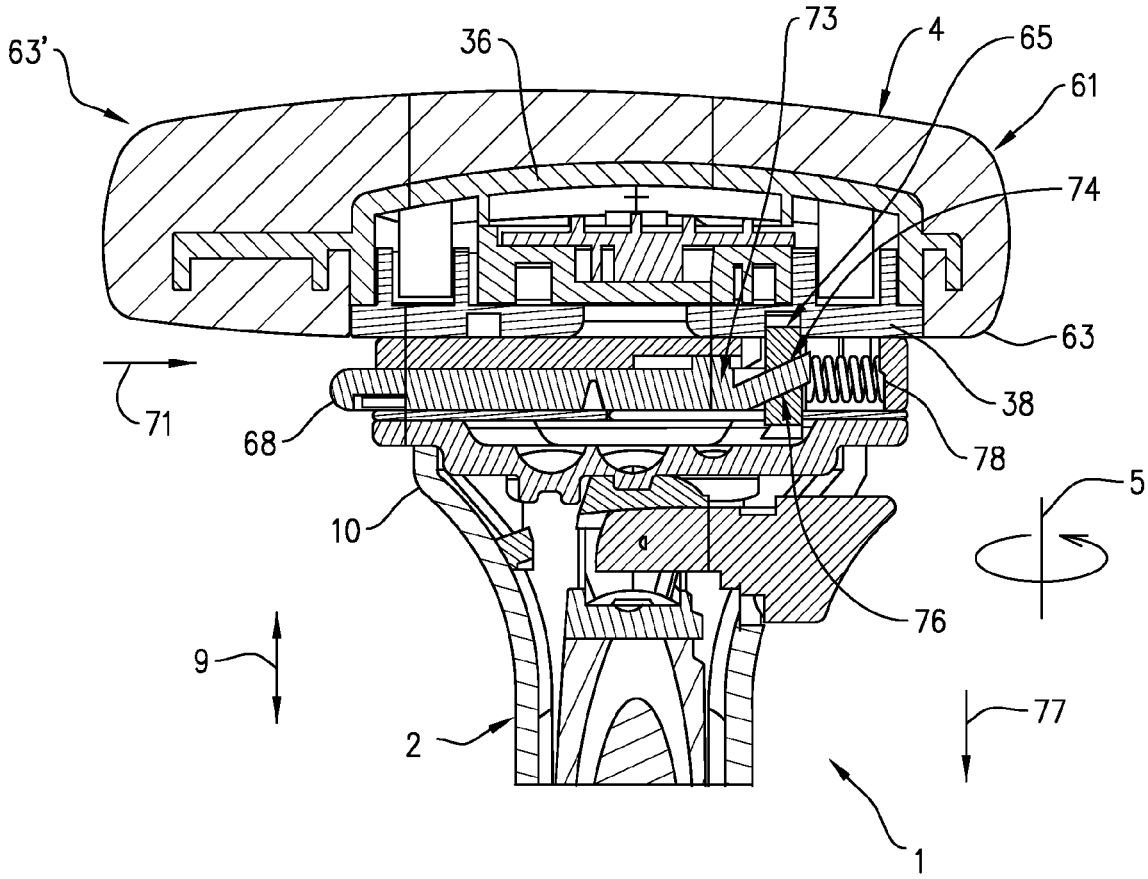
FIG. 4 is a diagrammatic, section view of the armrest in a lateral direction along the line IV-IV shown in FIG. 3.

The button 64, which is preferably made of a synthetic material, contains in detail a button element 68 and a pull-out finger 69 which is formed on the end of the button element 68. This is supported in such a way that it can be rotated on the opposite end of the button element 68 over a bearing point 72 on the load bearing element 18. On the end of the pull-out finger 69, a wedge 73 is formed as a single part, and in particular is attached using injection moulding. When the button 64 is pressed in the release direction 71, the button element 68 is rotated around the bearing point 72 in such a way that the pull-out finger 69 moves towards the locking tappet 65. Here, the pull-out finger 69 presses the tappet of the wedge 73 in the release direction 71 into the locking tappet 65, which contains a retainer opening 74 which has been adapted to the wedge form and which has been slanted in the same manner for this purpose. When the interim gradient surface 76 of the wedge 73 is inserted into the retainer opening 74, the locking tappet 65 is led out in a straight line from the locking recess 65 or 66 when the button 64 is pressed again; see FIG. 5. In other words, the arm support 4 is released for rotation. Since the locking process is achieved by the locking tappet moving either in or out in a straight line in the unlocking direction 77, see FIG. 4, the locking tappet 65 is prevented from being forced out of the locking recess when the arm support 4 is rotated.

A button element 68 is pressed and the locking tappet 65 is moved against the spring force of a spring element 78 which supports the locking tappet 65 against the edge of the load bearing element 18, thus preventing inadvertent unlocking.

Since the locking recesses 66, 67 are fitted on both sides of the guide channel 58, a rotation of the arm support 4 by 180 degrees is possible through to the next locking position. It should be noted that the configuration of the locking recesses 66, 67 as guide grooves ensures that the arm support 4 can also be moved in the longitudinal direction 6 when it is locked. Naturally, it is also possible to move it in the lateral direction 7 at any time. It is of course also possible to use the invention without the locking mechanism described. This will then provide a release button-free rotational, longitudinal and lateral adjustment mechanism 39, 35, 16.

When the fundamental idea of the invention and the embodiment of the invention explained in the description are applied, a person having the ordinary skill in the art will appreciate that many further examples of embodiments are possible which cannot however be described here in detail. It should be noted that all the features represented in the description, the claims and the drawings can be essential to the invention, either individually or in any combination with each other.

The invention claimed is:

1. An armrest, comprising:

a height-adjustable armrest column;

an arm support positioned on said armrest column, said arm support being asymmetrically constructed such that longitudinal sides of said arm support extend out different distances with respect to said armrest column; and a multi-function bearing head disposed on said armrest column and having adjustment mechanisms including a rotational adjustment mechanism, a longitudinal adjustment mechanism and a lateral adjustment mechanism for said arm support, said rotational adjustment mechanism enabling said arm support to be rotated by 360 degrees;

said lateral adjustment mechanism having a platform section and a load bearing element laterally moveable to said platform section, said load bearing element supporting said longitudinal adjustment mechanism;

said longitudinal adjustment mechanism having a linear sliding guide, said linear sliding guide having a longitudinal guide frame and a bearing block lying in said longitudinal guide frame, said rotational adjustment mechanism having a locking mechanism supported in said bearing block.

2. The armrest according to claim 1, wherein at least one of said adjustment mechanisms is free of a release button.

3. The armrest according to claim 1, further comprising a locking element for fixing said arm support in a standard position.

4. The armrest according to claim 1, wherein the armrest is for an office chair.

5. An office chair comprising:

two armrests according to claim 1, said armrests enabling a setting of a variable inner distance between said armrest by a rotation of said arm supports.

* * * * *